US006213856B1

(12) United States Patent
Cho et al.

(10) Patent No.: US 6,213,856 B1
(45) Date of Patent: Apr. 10, 2001

(54) CONDITIONER AND CONDITIONING DISK FOR A CMP PAD, AND METHOD OF FABRICATING, REWORKING, AND CLEANING CONDITIONING DISK

(75) Inventors: Sung-bum Cho; Baik-soon Choi; Jin-sung Kim, all of Kyungki-do; Kyue-sang Choi, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/293,946

(22) Filed: Apr. 19, 1999

(30) Foreign Application Priority Data

Apr. 25, 1998 (KR) ..... 98/14858

(51) Int. Cl.[7] ..... B24B 21/18

(52) U.S. Cl. ..... 451/443; 461/56; 461/444; 461/548

(58) Field of Search ..... 451/56, 443, 444, 451/461, 548

(56) References Cited

U.S. PATENT DOCUMENTS 2,137,329 * 11/1938 Boyer ..... 451/550
2,309,016 * 1/1943 Ryan ..... 451/550
2,451,295 * 10/1948 Metzger et al. ..... 451/461
5,569,062 * 10/1996 Karlsrud ..... 451/285
5,683,289 * 11/1997 Hempel ..... 451/56
5,921,856 * 7/1999 Zimmer ..... 451/539
5,941,761 * 8/1999 Nagahara et al. ..... 451/461
5,954,570 * 9/1999 Yano et al. ..... 451/285
5,989,103 * 11/1999 Birang et al. ..... 451/21
6,004,196 * 12/1999 Doan et al. ..... 451/443
6,051,495 * 4/2000 Burke et al. ..... 451/56

* cited by examiner

*Primary Examiner*—David A. Scherbel
*Assistant Examiner*—George Nguyen
(74) *Attorney, Agent, or Firm*—Jones Volentine, L.L.C.

(57) ABSTRACT

A conditioning disk and a conditioner for a chemical mechanical polishing (CMP) pad, and a method of fabricating, reworking, and cleaning the conditioning disk, are utilized to improve conditioning efficiency, and to reduce production expenses. The conditioning disk for a CMP pad is divided into regions defined by a size difference of abrasive grains formed on the body surface in each region of the conditioning disk. The method of fabricating the conditioning disk is performed by forming adhesive films for attaching the abrasive grains onto the body surface multiple times. In addition, a used conditioning disk may be reworked by detaching the abrasive grains from the body, and attaching new abrasive grains. A used conditioning disk can also be cleaned of by-products of the conditioning process by a cleaning method using a HF solution or BOE (buffered oxide etch) solution.

26 Claims, 8 Drawing Sheets

CONDITIONER AND CONDITIONING DISK FOR A CMP PAD, AND METHOD OF FABRICATING, REWORKING, AND CLEANING CONDITIONING DISK

BACKGROUND OF THE INVENTION

1. Field of the Invention

The present invention relates to chemical mechanical polishing (CMP), and more particularly, to a conditioner and a conditioning disk for conditioning a CMP pad, and a method of fabricating, reworking, and cleaning the conditioning disk.

2. Background of the Related Art

Highly integrated semiconductor devices require a sophisticated pattern formation technique, and use a multilayer structure for circuit distribution. This means that the surface structure of these semiconductor devices is more complicated, and step height differences between intermediary layers are more severe.

These step height differences cause many process failures in the semiconductor device fabrication process, for example, in the photolithography process for forming a photoresist pattern on a semiconductor wafer, which comprises the steps of coating the wafer with photoresist, aligning a mask having circuit patterns with the wafer having photoresist thereon, and performing an exposure process and a development process.

In the past, the formation method for precise patterns was easier, because the critical dimension (CD) of the pattern was relatively wide, and the semiconductor devices had fewer structural layers. However, the step height difference is increasing due to the finer patterns and multilayered structure of the modem devices. Therefore, it is more difficult to focus between the upper and the lower position of the step height during the exposure process, and it is also difficult to obtain more precise patterns.

Therefore, in order to reduce the step height difference, a planarization technique for the wafer has become important. A planarization technique such as SOG (Spin On Glass) film deposition has been introduced, or a partial planarization technique, such as etch back or reflow, etc., has been used, but many problems persist. Accordingly, a CMP (chemical mechanical polishing) technique for global planarization has been introduced, wherein the planarization is performed throughout the whole surface of the wafer.

The CMP technique planarizes the wafer surface through both chemical and mechanical reactions, whereby the protrusions existing on the surface of the thin film on the wafer chemically react with a slurry supplied to the wafer, with the surface of the wafer having the device pattern contacting a polishing pad surface. At the same time, the protrusions are planarized mechanically by rotation of a polishing table and the wafer.

Referring to FIGS. 1 and 2, the CMP apparatus 1 comprises a polishing table 10 having a polishing pad 12 made of polyurethane attached thereon, a wafer carrier 20 for fixing and rotating a wafer 16, with the thin film pattern 18 on the wafer 16 contacting the polishing pad 12, a slurry 14 supplied on the polishing pad 12, and a conditioner 22 displaced on the opposite side of the wafer carrier 20 and having a conditioning disk 24 attached thereon for conditioning the polishing pad 12.

In the CMP technique using the CMP apparatus 1, removal rate and planarization uniformity are very important, and these are determined by process conditions of the CMP apparatus 1, and the type of slurry 14 and polishing pad 12 used. In particular, the polishing pad 12 affects the removal rate, which should be properly maintained within a process specification by monitoring the surface state of the conditioning disk 24 of the conditioner 22 which conditions the polishing pad 12, and replacing the conditioning disk 24 when necessary.

Referring to FIG. 3, the conditioning disk 24 has artificial diamonds 26 attached to its surface by a nickel thin film used as an adhesive film 25, and the artificial diamond 26 abrades the surface of the polishing pad 12 which is made of polyurethane and has fine protrusions 27.

While the CMP process is continuously being performed for the wafer 16 on the polishing pad 12 by the supplied slurry 14, by-products 28 entrained in the slurry 14 are deposited between the protrusions 27.

Therefore, the surface of the polishing pad 12 becomes slippery with repeated CMP processing, thereby abruptly decreasing the removal rate for subsequent wafers. In order to restore the required removal rate, and maintain the condition of the polishing pad 12, a conditioning is performed to remove the by-products 28. The conditioning is performed by first placing the conditioning disk 24 with the artificial diamond 26 into contact with the surface of the polishing pad 12, and then, rotating the conditioning disk 24 at a certain speed so as to increase the roughness of the polishing pad 12. Therefore, the film of each wafer planarized during the CMP process is within a certain specification.

The conditioning method for the polishing pad 12 is different for a metallic film CMP than for an oxide film CMP. In the case of metallic film CMP, the conditioner 22 conditions the surface of the polishing pad 12 after the CMP for a wafer is preformed. For the oxide film, the CMP process is carried out by simultaneously performing the conditioning of the polishing pad 12 by the conditioner 22 and the CMP for the wafer.

Referring to FIGS. 4 and 5, the conditioning disk 24 has artificial diamonds 26 of a certain size attached on its surface with a nickel thin film 25 functioning as the adhesive. With the continuously-carried out CMP, the by-product 28 including the slurry 14 also accumulates between the artificial diamonds 26 on the conditioning disk 24 as well as on the polishing pad 12. The abrasion of the artificial diamonds 26 itself as well as the accumulation of the by-products 28 between the artificial diamonds 26 decreases the efficiency of the conditioning for the polishing pad 12.

That is, the conditioning effect of the conditioning disk 24 on the polishing pad 12 changes according to the state of the artificial diamonds 26 on the conditioning disk 24.

The size of the artificial diamonds 26 is approximately 68 $\mu$m, with approximately 30 to 40 $\mu$m protruding from the nickel thin film 25. As a result, the conditioning disk 24 has a short life time, and frequent replacement of the conditioning disk 24 results in decreased productivity and deterioration of production yield due to increased process failures.

SUMMARY OF THE INVENTION

The present invention is directed to providing a conditioning disk for a chemical mechanical polishing (CMP) pad for efficiently conditioning the polishing pad, and a method of fabricating the conditioning disk.

Another object of the present invention is to provide a method of reworking the conditioning disk, and a method of cleaning the conditioning disk to reduce production costs and lengthen the life of the disk by reworking a used conditioning disk.

To achieve these and other advantages and in accordance with the purpose of the present invention as embodied and broadly described, the conditioning disk for a CMP pad is divided into regions according to a size difference of the abrasive grains formed on each region of the body surface of the conditioning disk.

The abrasive grains may be artificial diamonds, which are attached to the regions of the body surface of the conditioning disk depending upon their size, one region having artificial diamonds of size greater than 200 $\mu$m, and another region having artificial diamonds of size less than 200 $\mu$m. The regions on the body surface of the conditioning disk are preferably formed to be concentric rings forming an inner region and an outer region.

The conditioning disk may be ring-shaped with an opening of a certain area in the center. Preferably, the inner region has artificial diamonds having a size of 200 to 300 $\mu$m provided thereon, and the outer region has artificial diamonds having a size of 100 to 200 $\mu$m provided thereon.

In another embodiment, the conditioning disk has a cross-shaped portion having an opening in its center with a certain area, and a ring-shaped portion adjacent to outer ends of the cross-shaped portion.

In this embodiment, the first region of the body surface has artificial diamonds having a size of 200 to 300 $\mu$m provided thereon, and comprises the surface of the cross-shaped portion and those sections of the ring-shaped portion extending from the outer ends of the cross-shaped portion. The second region has artificial diamonds having a size of 100 to 200 $\mu$m provided thereon, and comprises arc-shaped sections of the ring-shaped portion extending between the sections extending from the outer ends of the cross-shaped portion.

In another aspect of the present invention, a conditioner for a chemical mechanical polishing (CMP) pad comprises a bar, one end of which is revolvably installed on a fixed unit, a disk holder fastening device installed on the other end of the bar, a disk holder fixed on the disk holder fastening device, and a conditioning disk fixed on the disk holder, wherein the conditioning disk has a surface on which abrasive grains for conditioning a polishing pad are formed in regions defined by a size difference of the abrasive grains.

The conditioning disk may be ring-shaped having an opening in the center of its body, or the conditioning disk may have a cross-shaped portion having an opening in its center, and a ring-shaped portion adjacent to outer ends of the cross-shaped portion.

In another aspect of the present invention, a method of fabricating a conditioning disk of a chemical mechanical polishing (CMP) pad comprises the steps of: a) forming a first adhesive film on the body surface of the conditioning disk with a first thickness; b) attaching abrasive grains to the first adhesive film; c) forming a second adhesive film over the first adhesive film with a second thickness; d) removing incompletely-attached abrasive grains on the adhesive films; and e) forming a third adhesive film over the second adhesive film with a third thickness.

The steps of forming adhesive films may be performed by plating the adhesive film using an electrolytic polishing method. The step of attaching artificial diamonds may be performed multiple times, once on an inner region and once an outer region, the inner and outer regions being concentrically arranged on the surface of the body of the conditioning disk, and being defined according to the size difference of the artificial diamonds attached to the surface in each region.

The thickness of the first adhesive film may be 8 to 10% of a size of the abrasive grain, and the thickness of the second and the third adhesive films may be 15 to 20% of a size of the abrasive grain.

The method preferably comprises a further step of removing incompletely-attached abrasive grains on the adhesive film after the step of forming the third adhesive film. Further, the method may further comprise a step of forming a fourth adhesive film with a fourth thickness after the step of forming the third adhesive film.

In another aspect of the present invention, a method of reworking a conditioning disk for a chemical mechanical polishing (CMP) pad comprises the steps of: a) immersing a used conditioning disk in a chemical in order to dissolve adhesive film and remove abrasive grains attached on the body surface of the conditioning disk; b) cleaning the body surface of the conditioning disk; c) forming a first adhesive film with a first thickness on the body surface of the conditioning disk; d) attaching abrasive grains to the first adhesive film; e) forming a second adhesive film with a second thickness over the first adhesive film; f) removing incompletely-attached abrasive grains on the first and the second adhesive film; and g) forming a third adhesive film with a third thickness over the second adhesive film.

In another aspect of the present invention, a method of cleaning a conditioning disk for a chemical mechanical polishing (CMP) pad comprises the steps of: a) immersing a used conditioning disk in a chemical in order to remove by-products existing between abrasive grains on the body surface of the conditioning disk; b) cleaning the conditioning disk using deionized water; and c) drying the conditioning disk.

The by-products may be mixed compounds of oxide film and slurry, or mixed compounds of metallic film and slurry, and the chemical is HF (hydro fluoric) solution or BOE (buffered oxide etch) solution.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention in which.

DETAILED DESCRIPTION OF PREFERRED EMBODIMENTS

Reference will now be made in detail to preferred embodiments of the present invention, examples of which are illustrated in the accompanying drawings.

A conditioning disk for conditioning the surface of a polishing pad during the CMP (chemical mechanical polishing) process according to the present invention is described in detail.

The conditioning disk is made of metallic material, and its diameter is 90 to 110 mm. Abrasive grains, e.g. artificial diamonds, are provided on the surface of the conditioning disk protruding from its surface, wherein the artificial diamonds form specific distribution regions.

The artificial diamonds are distributed radially, forming a plurality of concentric ringed-regions, and preferably, the different regions being defined by the size of the artificial diamonds therein. For example, one region may contain artificial diamonds greater than 200 $\mu$m in size, and a second region may contain artificial diamonds having a size less than 200 $\mu$m.

Therefore, the distribution regions are divided according to the size difference of the artificial diamonds belonging to each group, and the regions can be referred to as an inner region and an outer region. Preferably, artificial diamonds having a size of 200 $\mu$m to 300 $\mu$m are formed on the inner region, and artificial diamonds having a size of 100 $\mu$m to 200 $\mu$m are formed on the outer region.

Figure 1:
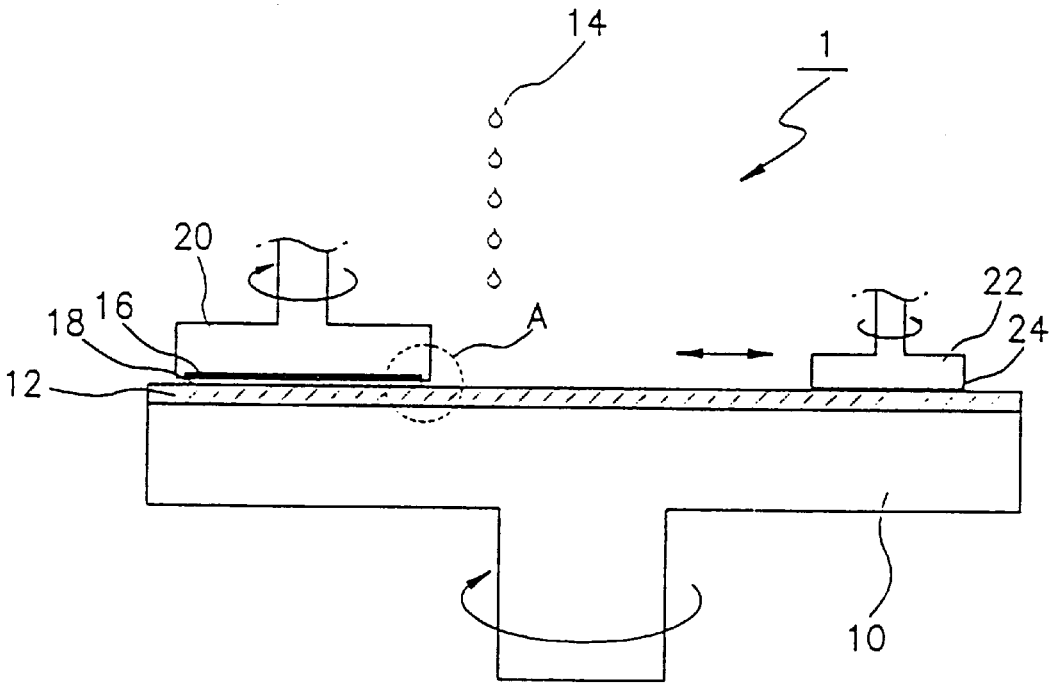
FIG. 1 (PRIOR ART)
FIG. 1 is a schematic representation showing a conventional CMP apparatus.
Figure 2:
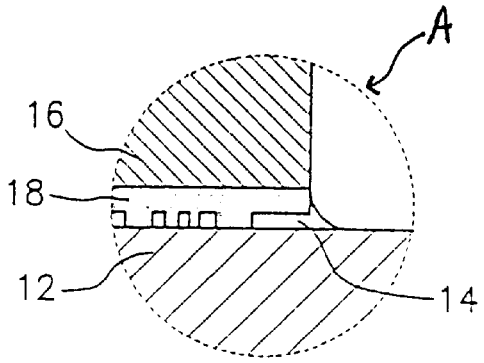
FIG. 2 (PRIOR ART)
FIG. 2 is an enlarged cross-sectional view of the portion A of FIG. 1.
Figure 3:
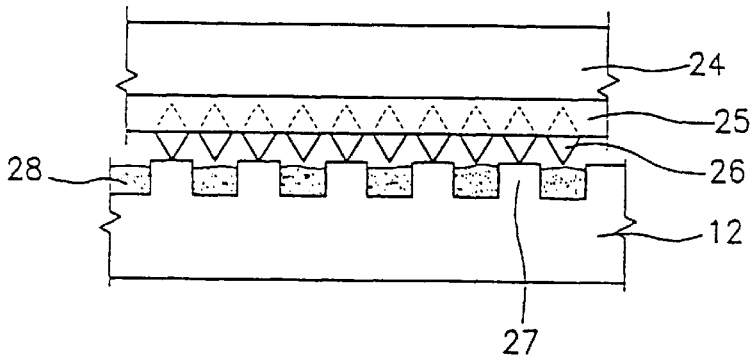
FIG. 3 (PRIOR ART)
FIG. 3 is a cross-sectional view showing the conventional conditioning disk conditioning a polishing pad.
Figure 4:
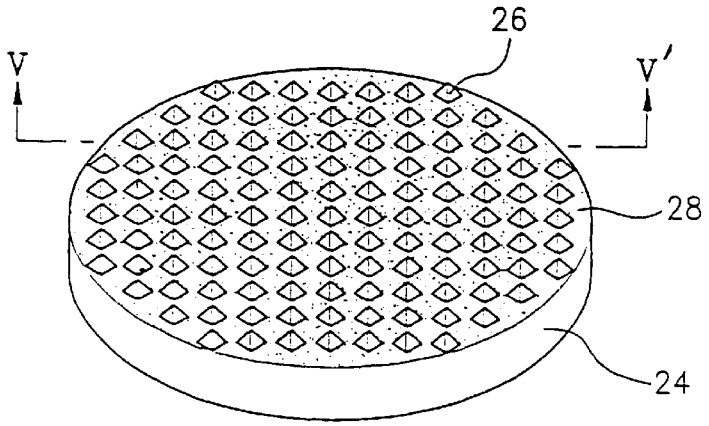
FIG. 4 (PRIOR ART)
FIG. 4 is a perspective view showing a conventional conditioning disk.
Figure 5:
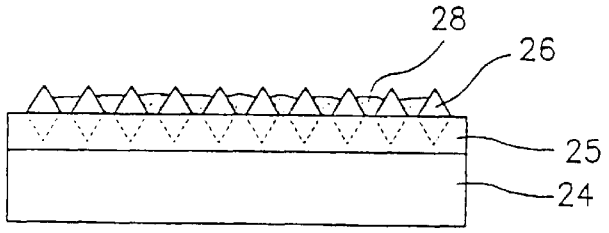
FIG. 5 (PRIOR ART)
FIG. 5 is a cross-sectional view taken along the line V–V' in FIG. 4.
Figure 6:
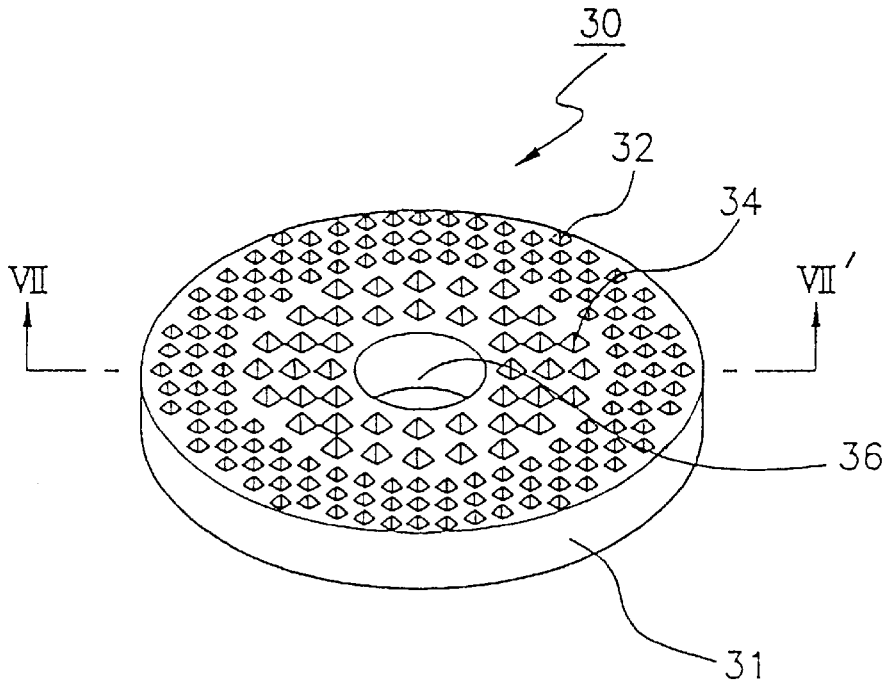
FIG. 6 is a perspective view showing a conditioning disk according to one embodiment of the present invention.
Figure 7:
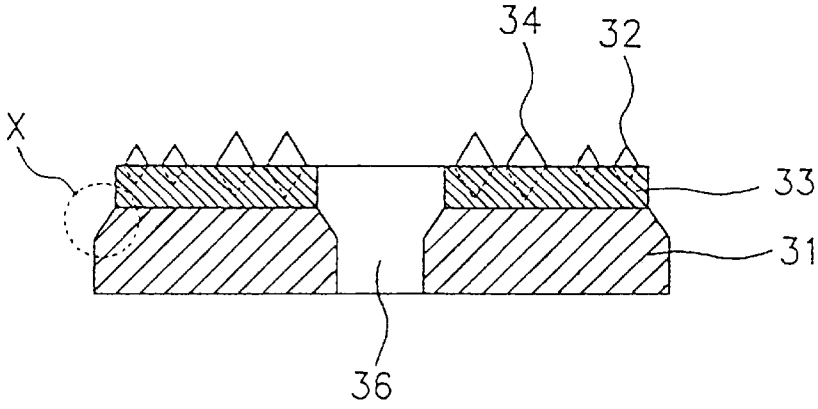
FIG. 7 is a cross-sectional view taken along the line VII–VII' in FIG. 6.

For example, referring to FIGS. 6 and 7, the conditioning disk 30 is ring-shaped, the center of the disk body 31 of the ring-shaped conditioning disk 30 having a certain area. That is, the disk body 31 of the conditioning disk 30 is ring-shaped with a certain diameter, its center 36 being a through hole.

Artificial diamonds 32, 34 are distributed in a nickel thin film 33 on the disk body 31. The inner region can be defined as a region having artificial diamonds 34 radially distributed over a certain range as measured from the center 36, and the size of those artificial diamonds is from 200 to 300 $\mu$m. That is, the inner region is ring-shaped, and is concentric with and located adjacent to the opening 36. The outer region is defined as the remaining region of the disk body 31 not included in the inner region, and artificial diamonds 32 having a size from 100 to 200 $\mu$m are formed thereon. The outer region is also ring-shaped, and is concentric with and located adjacent to the inner region. Preferably, the ratio of the width, measured in the radial direction, of the two regions is 1:1.

The presence of the center 36, which is the opening in the disk body 31, functions to improve the uniformity of the conditioning of the polishing pad by preventing the concentration of forces on the center 36 during conditioning. In addition, the life of the conditioning disk 30 can be lengthened because artificial diamonds 32, 34 of larger than a conventional size are used, and therefore, the protrusions on the nickel thin film 33 of the conditioning disk 30 are larger.

Further, the conditioning efficiency can be improved by using diamonds 32, 34 having different sizes. Also, the outer edge 39 of the disk body 31 may be obliquely cut at an angle of 25° to 45° (or rounded off as shown in FIG. 9), so that the polishing pad is not damaged by the outer edge of the disk body 31 during the conditioning.

Figure 8:
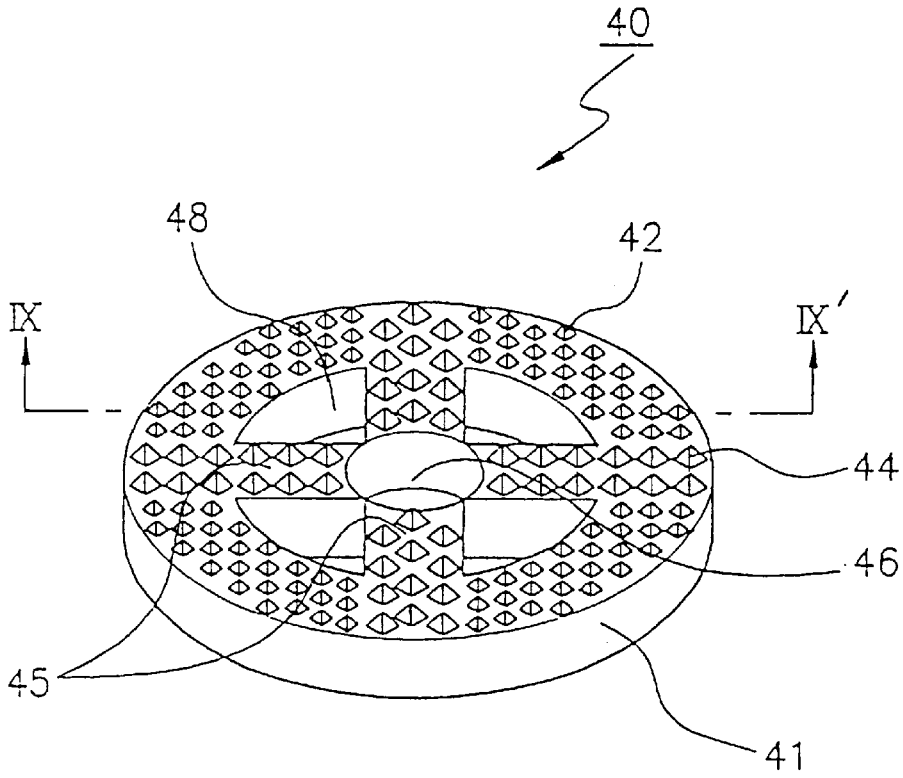
FIG. 8 is a perspective view showing a conditioning disk according to a second embodiment of the present invention.
Figure 9:
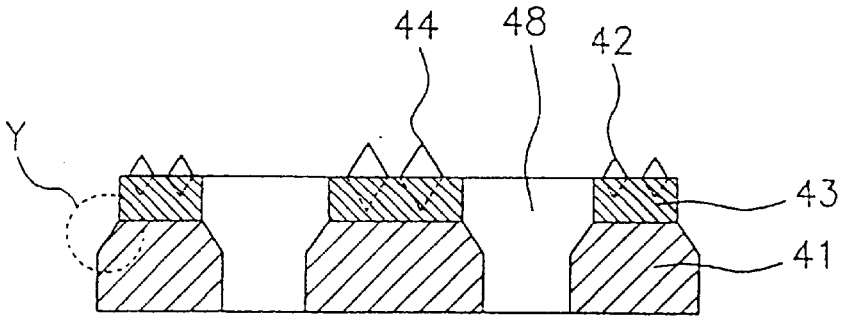
FIG. 9 is a cross-sectional view taken along the line IX–IX' in FIG. 8.

In another embodiment of the present invention as shown in FIGS. 8 and 9, the conditioning disk 40 has a cross-shaped portion 45 with an opening at its center 46 having a certain width, and a ring-shaped portion 47 adjacent to outer ends of the legs of the cross-shaped portion. The conditioning disk 40 comprises a disk body 41, a center 46, which passes through the disk body 41, artificial diamonds 42, 44, which are formed in a nickel thin film 43 on the surface of the disk body 41, a cross-shaped portion 45, openings 48 which penetrate the disk body 41 between adjacent legs of the cross-shaped portion 45, the center 46 and the ring-shaped portion.

The artificial diamonds 44 formed on the cross-shaped portion 45 of the disk body 41, and on sections of the ring-shaped portion of the disk body 41 extending from the outer end of each leg of the cross-shaped portion 45 to the outer diameter of the disk body 41 as illustrated in FIG. 8, have a size of 200 to 300 $\mu$m. The remaining arc-shaped sections of the ring-shaped portion have artificial diamonds 42 of a size of 100 to 200 $\mu$m formed thereon.

The shape of the conditioning disk as illustrated above helps to improve the uniformity of conditioning of the polishing pad by distributing the rotation force of the conditioning disk 40 during conditioning.

In addition, the life of the conditioning disk 40 can be increased because the artificial diamonds 42, 44 have a larger than conventional size, so that the protrusions on the nickel thin film 43 on the conditioning disk 40 are larger.

Further, the conditioning efficiency can be improved by using the artificial diamonds 42, 44 having different sizes.

Also, the outer edge 49 of the disk body 41 may be rounded off (or obliquely cut at an angle of 25° to 45° as shown in FIG. 7), so that the polishing pad is not damaged by the outer edge of the disk body 41 during conditioning of the polishing pad.

Using the conditioning disks 30, 40 having artificial diamonds 32, 34 and 42, 44 formed thereon, as illustrated in the above embodiments, the life time of the conditioning disk is increased to greater than 150% of the standard conditioning time, as compared with the conventional case having artificial diamonds of a size of approximately 68 $\mu$m.

Figure 10:
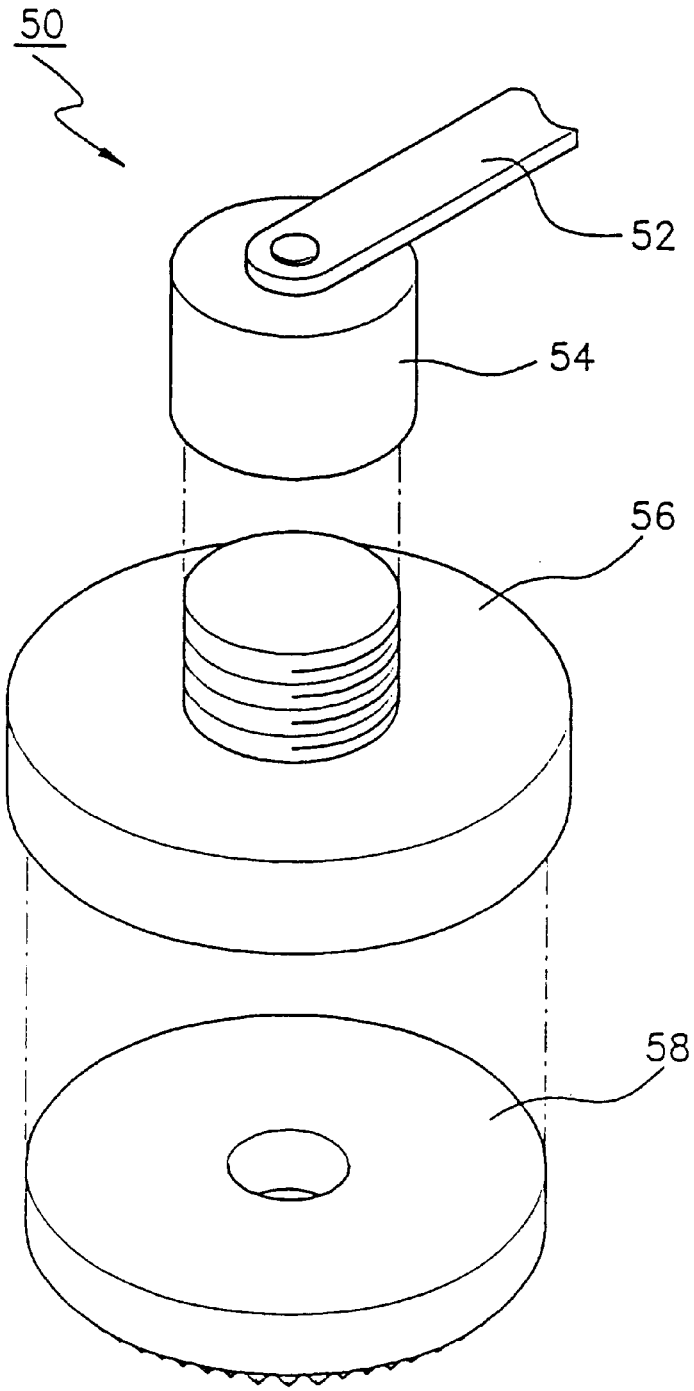
FIG. 10 is a schematic view showing a conditioner according to the present invention.

Referring to FIG. 10, a conditioner 50 for the CMP pad according to the present invention comprises a bar 52, one end of which is revolvably installed on a certain fixed unit (not shown), a disk holder fastening device 54 on the end of the bar 52, a disk holder 56 fixed on the disk holder fastening device 54, and a conditioning disk 58 fixed on the disk holder 56. Abrasive grains for conditioning the polishing pad are formed on the surface of the conditioning disk 58, divided into regions according to the size of the abrasive grains.

The body of the conditioning disk 58 is metal, and inside the disk holder 56 there is installed a magnet (not shown). The conditioning disk 58 is fastened on the disk holder 56 by magnetic force.

The bar 52 can move up and down, and back and forth, and the disk holder 56 can be rotatable. Therefore, the surface of the polishing pad can be effectively conditioned by the linear movement of the bar 52, and the rotation of the disk holder 56.

The conditioning disk 58 can be disk-shaped, for example as in the embodiments of the conditioning disks 30, 40, described above.

Figure 11:
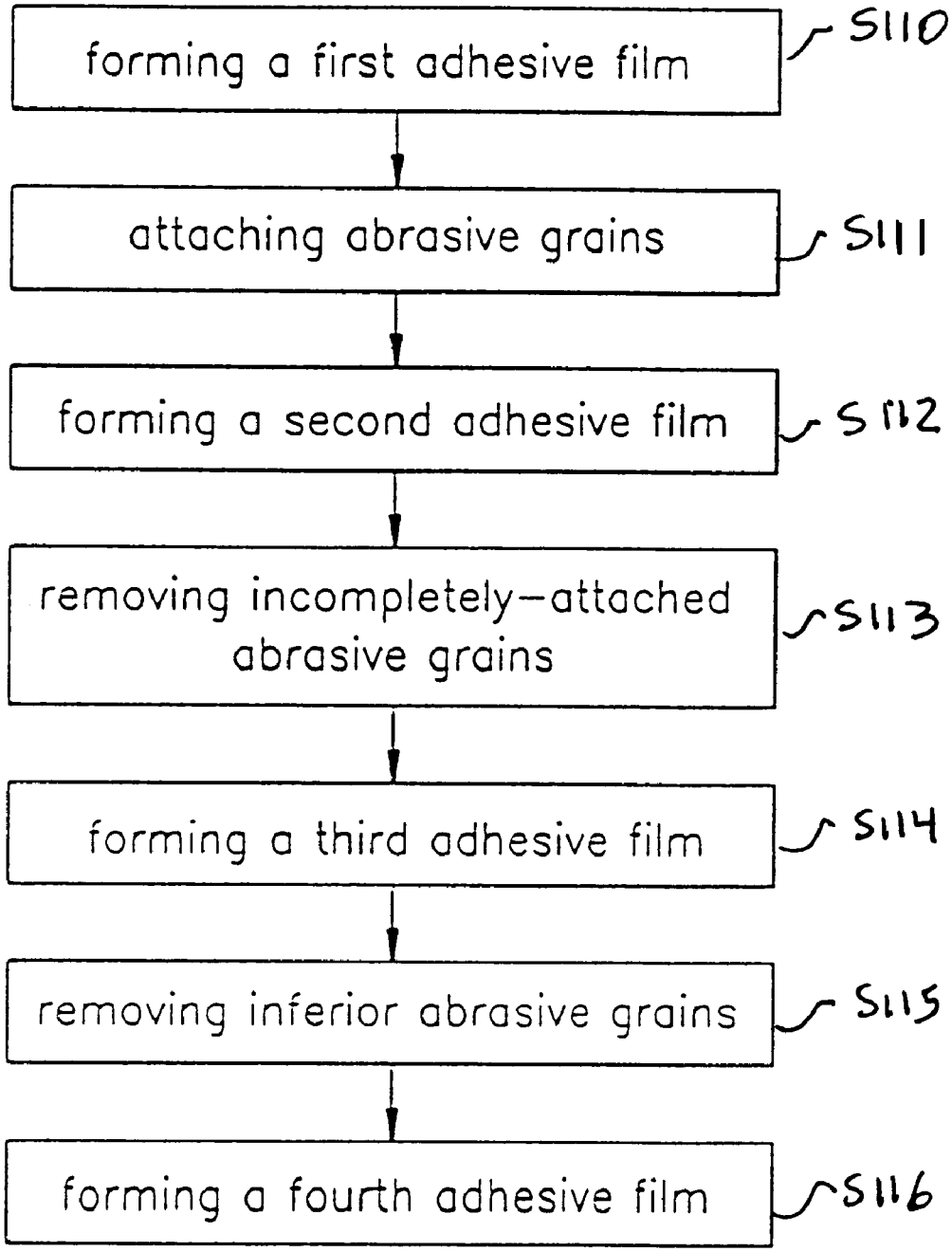
FIG. 11 shows processing sequences of a fabrication method of a conditioning disk according to the present invention.

In another aspect of the present invention, a method of fabricating the conditioner of the present invention is illustrated, as in FIG. 11 showing a processing sequence thereof.

First (S110), a first adhesive film is formed on the surface of the body of a conditioning disk for conditioning a CMP polishing pad, by fastening the body of the conditioning disk onto an electrolytic polishing apparatus, and forming an adhesive film, such as a nickel film, on the surface of the conditioning disk with a thickness of 8 to 10% of the size of the abrasive grain. Artificial diamond or other materials can be used for the abrasive grains.

Second (S111), the abrasive grains are attached to the first adhesive film, that is, artificial diamonds having uniform size are sprayed over the nickel film.

Third (S112), a second adhesive film is additionally formed on the first adhesive film with a certain thickness, that is, a second nickel film is formed on the first nickel film, the second nickel film having a thickness of 15 to 20% of the size of the artificial diamonds, so as to fix the artificial diamonds.

Fourth (S113), any abrasive grains which are incompletely attached to the adhesive films are removed. Not all of the artificial diamonds are uniformly fixed/formed on the body surface of the conditioning disk, because they are attached by spraying them over the nickel thin film, and not by individually attaching them to the body surface one by one. Therefore, the incompletely-attached artificial diamonds could fall off, thereby increasing process failures such as scratches on the wafer surface.

The removal of the incompletely-attached artificial diamonds is accomplished by brushing the attached artificial diamonds so that any that are weakly-attached are thereby removed.

Fifth (S114), a third adhesive film is additionally formed over the second adhesive film, by forming a nickel thin film with a thickness of approximately 15 to 20% of the size of the artificial diamond, so as to fix the artificial diamonds more firmly.

Sixth (S115), any abrasive grains which are incompletely attached to the adhesive film are removed, as in the fourth step above.

Seventh (S116), a fourth adhesive film is formed on the whole surface of the conditioning disk, which is carried out by forming a nickel thin film with a thickness of approximately 1 to 3% of the size of the artificial diamonds. That is, the nickel thin film is coated on the whole surface of the conditioning disk including the back-side of the conditioning disk and any surface area of the conditioning disk from which incompletely-attached artificial diamonds have been removed.

Figure 12:
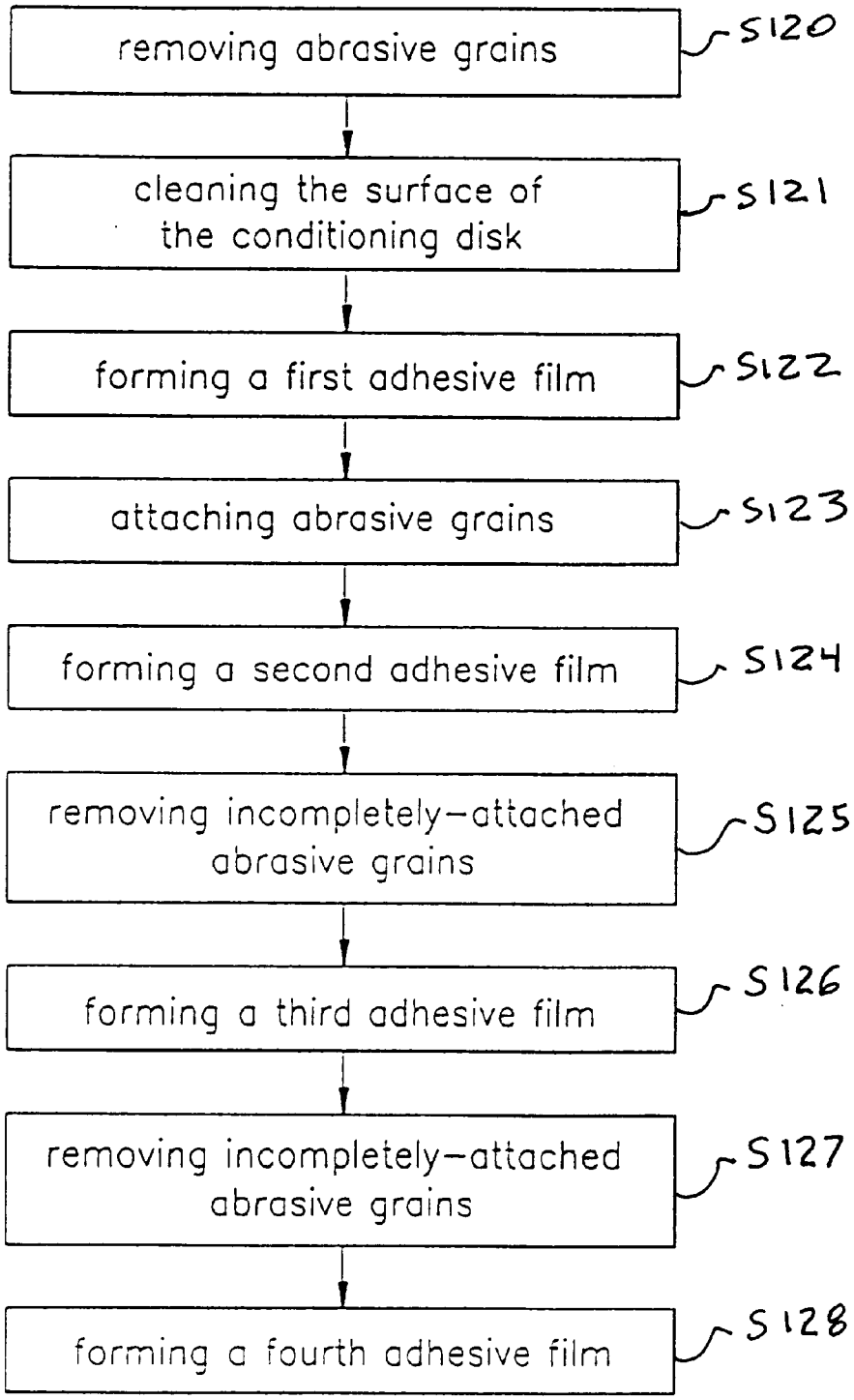
FIG. 12 shows processing sequences of a rework method of a conditioning disk according to one embodiment of the present invention.

FIG. 12 shows a processing sequence for a method of reworking a conditioning disk according to one embodiment of the present invention.

Referring to FIG. 12, first (S120), the conditioning disk is immersed in a chemical for removing the nickel thin film and the artificial diamonds, that is, the conditioning disk is immersed in strong acid, such as a sulfuric acid solution, in order to dissolve the nickel thin film, which is the adhesive film which attaches the artificial diamonds to the body surface. Therefore, the used artificial diamonds are taken off.

Second (S121), the body surface of the conditioning disk is cleaned in order to remove the chemicals used for taking off the artificial diamonds, and any organic materials, contaminants, etc.

After the above process, new artificial diamonds are attached on the surface of the conditioning disk according to the above described fabrication method for a conditioning disk according to the present invention. These additional steps (S122–S128) are the same as those shown in FIG. 11 (S110–S116), and proceed as described above. This reworking method results in savings on production expenses, because it allows for reuse of the conditioning disk, whereas in the conventional case, the once-used conditioning disk is discarded.

Figure 13:
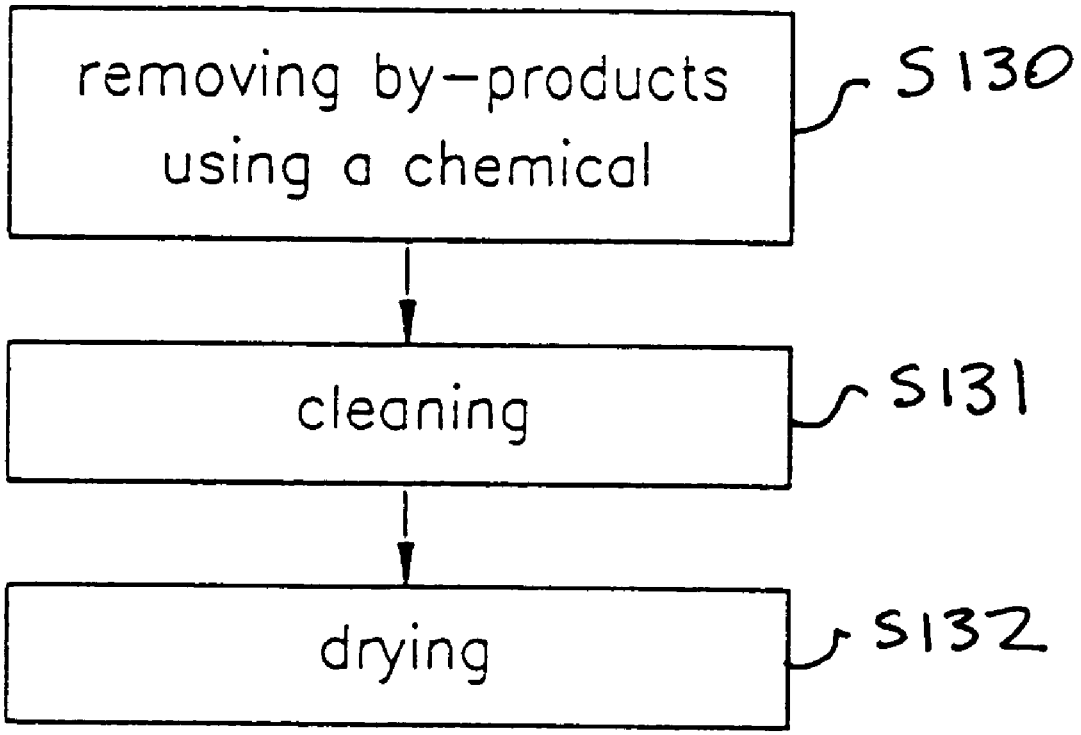
FIG. 13 shows processing sequences of a cleaning method of a conditioning disk according to one embodiment of the present invention.

FIG. 13 shows a processing sequence for a cleaning method for cleaning a conditioning disk according to one embodiment of the present invention.

Referring to FIG. 13, first (S130) by-products of CMP processing, such as mixed compounds of oxide film and slurry, or mixed compounds of metallic film and slurry, which remain between the abrasive grains can be removed by immersing the conditioning disk in a certain chemical. That is, the conditioning disk having the artificial diamonds, which was used in repetitive CMP processing, is immersed in a chemical such as HF (hydro fluoric) solution comprising deionized water and HF with a mixed ratio of 90 to 100:1, or BOE (buffered oxide etch) solution, so as to remove the by-products of the process existing between the protrusions of the artificial diamonds on the conditioning disk.

The presence of such by-products reduces the conditioning efficiency of the polishing pad. The conditioning disk is immersed in the HF solution or BOE solution for preferably 20 to 60 min.

Second (S131), the conditioning disk is cleaned by deionized water. That is, the conditioning disk is put into a bath, and by continuously supplying deionized water into the bath, the HF solution, or BOE solution remaining on the surface of the conditioning disk is cleaned by an overflow method.

Third (S132), the conditioning disk is dried. That is, nitrogen gas is blown so as to remove the moisture on the surface of the conditioning disk, and then, an oven is employed so as to remove any remaining moisture on the conditioning disk. The drying time using the oven is preferably 20 to 40 min.

According to the test results for a monitoring wafer employing the conditioning disk passing through the above cleaning process, the polishing rate, which had decreased to less than 3200 Å/min. by the removing of by-products between the abrasive grains, was restored to 3200 to 3600 Å/min.

Further, the useful life of the conditioning disk was increased by approximately 50% by using the cleaning method, thereby reducing production expenses. However, the useful life of the conditioning disk cannot be increased by 100%, because the size of the artificial diamonds themselves is reduced due to the abrasion by the repeated CMP process. Therefore, the production expenses are reduced by improving the conditioning efficiency and lengthening the life of the conditioning disk.

In the accompanying drawings and specification, there have been disclosed typical preferred embodiments of the invention and, although specific terms are employed, they are used in a generic and descriptive sense only and not for purposes of limitation, the scope of the invention being set forth in the following claims.

It will be apparent to those skilled in the art that various modifications and variations of the present invention can be made without departing from the spirit or scope of the invention. Thus, it is intended that the present invention cover the modifications and variations of this invention that come within the scope of the appended claims and their equivalents.

What is claimed is:

1. A conditioning disk for a chemical mechanical polishing (CMP) pad, comprising a body having a surface, the surface having abrasive grains attached thereto in inner and outer regions formed on the surface, grain size of the abrasive grains in the inner region being greater than grain size of the abrasive grains in the outer region.

2. The conditioning disk for a CMP pad according to claim 1, wherein a diameter of the body is 90 to 110 mm.

3. The conditioning disk for a CMP pad according to claim 1, wherein the body is made of metal.

4. The conditioning disk for a CMP pad according to claim 1, wherein the abrasive grains are artificial diamonds.

5. The conditioning disk for a CMP pad according to claim 4, wherein the inner region has artificial diamonds having a size greater than 200 $\mu$m and the outer region has artificial diamonds having a size less than 200 $\mu$m.

6. The conditioning disk for a CMP pad according to claim 1, wherein the inner and outer regions are formed as concentric rings.

7. The conditioning disk for a CMP pad according to claim 6, wherein artificial diamonds having a size of 200 to 300 $\mu$m are provided on the inner region.

8. The conditioning disk for a CMP pad according to claim 6, wherein artificial diamonds having a size of 100 to 200 $\mu$m are provided on the outer region.

9. A conditioning disk for a chemical mechanical polishing (CMP) pad comprising a ring-shaped body having a surface, the surface having abrasive grains attached thereto in inner and outer regions formed on the surface, grain size of the abrasive grains in the inner region being greater than size of the abrasive grain in the outer region, the body having an opening at a center of the body.

10. The conditioning disk for a CMP pad according to claim 9, wherein the inner region is ring-shaped, is concentric with the opening of the body, is located adjacent to the opening, and has artificial diamonds having a size of 200 to 300 $\mu$m provided thereon.

11. The conditioning disk for a CMP pad according to claim 10, wherein the outer region is ring-shaped, is concentric with the inner region, is located adjacent to the inner region, and has artificial diamonds having a size of 100 to 200 $\mu$m provided thereon.

12. The conditioning disk for a CMP pad according to claim 9, wherein an outer edge of the body of the conditioning disk is formed at an angle.

13. The conditioning disk for a CMP pad according to claim 12, wherein the angle is 25° to 45°.

14. The conditioning disk for a CMP pad according to claim 9, wherein an outer edge of the body of the conditioning disk is rounded off.

15. A conditioning disk for a chemical mechanical polishing (CMP) pad, comprising a body having a surface, the surface having abrasive grains attached thereto in regions formed on the surface, the regions being defined by size of the abrasive grains in each region, the body having a cross-shaped portion having an opening at a center of the body, and a ring-shaped portion adjacent to outer ends of the cross-shaped portion.

16. The conditioning disk for a CMP pad according to claim 15, wherein a first one of the regions comprises the cross-shaped portion and sections of the ring-shaped portion extending from the outer ends of the cross-shaped portion, the first region being provided with artificial diamonds having a size of 200 to 300 $\mu$m.

17. The conditioning disk for a CMP pad according to claim 16, wherein a second one of the regions comprises arc-shaped sections of the ring-shaped portion, the arc-shaped sections extending between the sections extending from the outer ends of the cross-shaped portion, the second region being provided with artificial diamonds having a size of 100 to 200 $\mu$m.

18. The conditioning disk for a CMP pad according to claim 15, wherein an outer edge of the body of the conditioning disk is formed at an angle.

19. The conditioning disk for a CMP pad according to claim 18, wherein the angle is 25° to 45°.

20. The conditioning disk for a CMP pad according to claim 15, wherein an outer edge of the body of the conditioning disk is rounded off.

21. A conditioner for a chemical mechanical polishing (CMP) pad comprising:

a bar, one end of which is revolvably installed on a fixed unit;

a disk holder fastening device installed on another end of the bar;

a disk holder fixed on the disk holder fastening device; and a conditioning disk fixed on the disk holder, the conditioning disk having a surface including inner and outer regions on which abrasive grains for conditioning a polishing pad are formed, grain size of the abrasive grains in the inner region being greater than grain size of the abrasive grains in the outer region.

22. The conditioner for a CMP pad according to claim 21, wherein the conditioning disk is made of metal.

23. The conditioner for a CMP pad according to claim 21, wherein a magnet is provided inside the disk holder.

24. The conditioner for a CMP pad according to claim 21, wherein the bar moves up and down, and the disk holder rotates.

25. The conditioner for a CMP pad according to claim 21, wherein the conditioning disk is ring-shaped having an opening at a center of the conditioning disk.

26. The conditioner for a CMP pad according to claim 21, wherein the conditioning disk has a cross-shaped portion having an opening at a center of the conditioning disk and a ring-shaped portion adjacent to outer ends of the cross-shaped portion.

* * * * *